US005213037A

United States Patent [19]

Leopardi, II

[11] Patent Number: 5,213,037

[45] Date of Patent: May 25, 1993

[54] APPARATUS FOR APPLYING INK TO A SUBSTRATE

[75] Inventor: Emmett Leopardi, II, Cincinnati, Ohio

[73] Assignee: The Procter & Gamble Company, Cincinnati, Ohio

[21] Appl. No.: 917,528

[22] Filed: Jul. 17, 1992

Related U.S. Application Data

[63] Continuation of Ser. No. 608,513, Nov. 2, 1990, abandoned.

[51] Int. Cl.[5] ..... B41F 31/04; B41F 31/06

[52] U.S. Cl. ..... 101/363; 101/366

[58] Field of Search ..... 101/365, 366, 750, 363, 101/364, 148, 207, 208, 209, 210, 157, 169; 118/244, 258, 259, 261

[56] References Cited

U.S. PATENT DOCUMENTS

| | | | |
|---|---|---|---|
| 2,368,776 | 2/1945 | Piazze | 101/157 |
| 3,630,146 | 12/1971 | Shields | 101/366 |
| 3,658,003 | 4/1972 | Johnson | 101/157 |
| 3,709,147 | 1/1973 | Granger | 101/351 |
| 3,793,952 | 2/1974 | Neumann et al. | 101/157 |
| 4,461,211 | 7/1984 | Wesselmann | 101/169 |
| 4,497,250 | 2/1985 | Dressler | 101/366 |
| 4,581,995 | 4/1986 | Stone | 101/366 |
| 4,590,855 | 5/1986 | Schommer et al. | 101/157 |
| 4,688,516 | 8/1987 | Sommer | 118/410 |
| 4,821,672 | 4/1989 | Bruno | 118/261 |
| 4,878,427 | 11/1989 | Washchynsky et al. | 101/219 |
| 4,879,949 | 11/1989 | Vennike | 101/157 |
| 4,938,133 | 7/1990 | Bock et al. | 101/349 |
| 4,942,815 | 7/1990 | Greer et al. | 101/352 |
| 4,945,832 | 8/1990 | Odom | 101/350 |
| 5,072,669 | 12/1991 | Weisbrod et al. | 101/363 |

FOREIGN PATENT DOCUMENTS

| | | | |
|---|---|---|---|
| 59-62152 | 4/1984 | Japan | 101/366 |
| 2158371 | 5/1984 | United Kingdom . | |

*Primary Examiner*—J. Reed Risher

*Attorney, Agent, or Firm*—Larry L. Huston; Fredrick H. Braun

[57] ABSTRACT

This invention relates to an anilox printing apparatus for depositing ink onto a substrate in a predetermined pattern. The apparatus has a reservoir provided with a weir so that ink may continuously overflow the top or end of the weir and be removed from the reservoir in a controlled fashion while maintaining a constant back-pressure of ink in the reservoir. This arrangement provides the advantage that ink leakage and splashing caused by debris entering the nip associated with a doctor blade held against the anilox roll or by surface imperfections interfering with the seal formed by such a doctor blade are eliminated. This also provides a printing apparatus for complete coating of the periphery of the anilox roll with ink without a high pressure system.

4 Claims, 5 Drawing Sheets

APPARATUS FOR APPLYING INK TO A SUBSTRATE

This is a continuation of application Ser. No. 07,608,513, filed on Nov. 2, 1990.

FIELD OF THE INVENTION

This invention relates to an apparatus and method for applying a liquid composition to a substrate in a predetermined pattern, particularly to an apparatus and method for printing a liquid composition onto a substrate, and more particularly to an improved printing apparatus and method of printing for use in flexography.

BACKGROUND OF THE INVENTION

Applying a liquid composition, such as ink, onto a substrate by printing and by other means is well known in the art. Printing of ink may be done to make aesthetically pleasing designs on the substrate. Such designs are desired by the consumer and may increase sales of the product embodying the printed substrate. Alternatively, the substrate may be coated with liquid compositions having desired properties, such as surfactants to increase hydrophilicity, adhesives to join two substrates together, or silicones to promote tactile sensation.

In the printing arts, such as flexography, rotary apparatuses are used for applying various liquid compositions to a travelling substrate. Such apparatuses typically comprise a frame, an axially rotatable anilox roll mounted on the frame, and a reservoir for holding the liquid composition until it is removed from the reservoir by the anilox roll. In the prior art, the reservoir was open to the atmosphere.

One improvement to apparatuses according to the prior art was to provide multiple doctor blades, typically two, contacting the periphery of the anilox roll so that a closed reservoir was formed. As illustrated in U.S. Pat. No. 4,945,832 issued Aug. 7, 1990 to Odom, this arrangement is helpful in preventing splashing of the liquid composition from a reservoir open to the atmosphere.

Various efforts have been made to properly locate the closed reservoir relative to the anilox roll. For example, the aforementioned Odom patent locates the reservoir at the bottom dead center of the anilox roll. U.S. Pat. No. 4,821,672 issued Apr. 18, 1989 to Bruno teaches a laterally mounted reservoir, disposed at the three o'clock position on the anilox roll. However, all such closed reservoirs require complex sealing means to maintain the pressure boundary for the liquid composition. For example, the aforementioned Bruno patent and U.S. Pat. No. 4,481,995 issued Apr. 15, 1986 to Stone both disclose sealing arrangements, for the ends of the anilox roll, which seals are necessary to maintain the pressure boundary of the reservoir.

Yet another problem with such printing apparatuses is the wear and adjustment of the doctor blade which forms part of the pressure boundary of the reservoir and contacts the anilox roll to form an in-running nip. This doctor blade is subject to abrasion from debris entering the nip. Even slight asperities from such debris and routine wear and tear will breach the pressure boundary of the reservoir and cause unintended and undesired loss of ink therefrom.

One approach to this problem has been proposed in U.S. Pat. No. 4,938,133 issued Jul. 3, 1990 to Bock et al., which patent discloses an apparatus to permit easy removal, engagement, and disengagement of the doctor blade. However, this approach is not entirely satisfactory, as the original problem of doctor blade replacement and maintenance still persists.

Yet another problem with the apparatuses according to the prior art, and having either an open reservoir or a closed reservoir, is the complex arrangement necessary to remove the reservoir from its operational position for routine maintenance. Maintenance typically requires draining the reservoir and concomitantly significant downtime. Typically, a hingeably connected reservoir must be removed from its operating position to allow any significant maintenance to be performed. One approach to this problem is suggested in U.S. Pat. No. 4,878,427 issued Nov. 7, 1989 to Washchynsky et al., which discloses an apparatus for removing the anilox roll without tools. However, not all maintenance problems can be corrected by interchanging the anilox roll.

Accordingly, it is an object of this invention to overcome the problems associated with printing apparatuses of the prior art. Particularly, it is an object of this invention to provide a means for minimizing undesired splashing of ink from the reservoir of the printing apparatus. Further, it is an object of this invention to prevent wastage of ink from occurring when ink is removed from the reservoir without being applied onto substrate.

It is also an object of this invention to provide a more reliable means for assuring proper coating of the ink onto the anilox roll so that streaking and fading of the pattern onto the substrate is minimized even at high speed operation. Finally, it is an object of this invention to provide an improved means for separating the reservoir and anilox roll relative to one another, so that downtime is minimized when maintenance occurs and less waste of ink occurs when the reservoir and anilox roll are in the separated position.

BRIEF SUMMARY OF THE INVENTION

The present invention is an apparatus for applying ink to a substrate. The apparatus comprises a reservoir for containing the ink, a means for supplying ink to the reservoir, a means for removing ink from the reservoir and applying ink onto the substrate in a preselected pattern, a means for transporting the substrate relative to the means for removal and application of the ink, and an orifice for removing ink from the reservoir in a controlled manner and without transfer to the substrate. The orifice has at least one border defined by the means for removing ink from the reservoir and applying ink onto the substrate.

The invention is also an apparatus for applying ink onto a substrate and comprising a reservoir for containing the ink, a means for removing ink from the reservoir and applying ink to the substrate in a predetermined pattern, a second means for removing ink from the reservoir without applying such ink onto the substrate, and a means for creating a backpressure in the reservoir. The means for creating the backpressure in the reservoir comprises an orifice having at least one border defined by the second ink removal means.

The means for removing ink from the reservoir and applying ink to the substrate may comprise an axially rotatable anilox roll partially submerged in the reservoir. In one embodiment, the orifice has at least one border defined by the distal edge of a weir disposed substantially parallel to the axis of the anilox roll. In another embodiment, the orifice has at least one border defined by the end of a weir disposed substantially parallel to the axis of the anilox roll.

The invention is also an apparatus for applying ink onto a substrate and comprising a reservoir for containing the ink, a means for supplying ink to the reservoir, a means for removing ink from the reservoir and applying it to the substrate, and a means for separating the reservoir and the balance of apparatus from one another by linear translation of at least one of the reservoir and the balance of the apparatus. The linear separating means may be a component selected from the group consisting of a jack screw, a pneumatic cylinder, or preferably a hydraulic cylinder.

The invention further comprises a process for printing ink onto a substrate and comprising the steps of providing a reservoir, providing a substrate, providing a means to transfer ink from the reservoir to the substrate, and providing an orifice in the reservoir having one border defined by the transfer means. Ink is supplied to the reservoir and is transferred from the reservoir to the substrate. Nontransferred ink is removed from the reservoir through the orifice. Nontransferred ink may be substantially continuously removed from the reservoir and overflowed past either the top, or past one or both ends of a weir which defines a boundary of the reservoir.

BRIEF DESCRIPTION OF THE DRAWINGS

While the Specification concludes with claims particularly pointing out and distinctly claiming the present invention, it is believed the same will be better understood from the following Specification taken in conjunction with the associated drawings wherein like parts are given the same reference numeral, analogous parts are designated with a prime symbol, and:

DETAILED DESCRIPTION OF THE INVENTION

Figure 1:
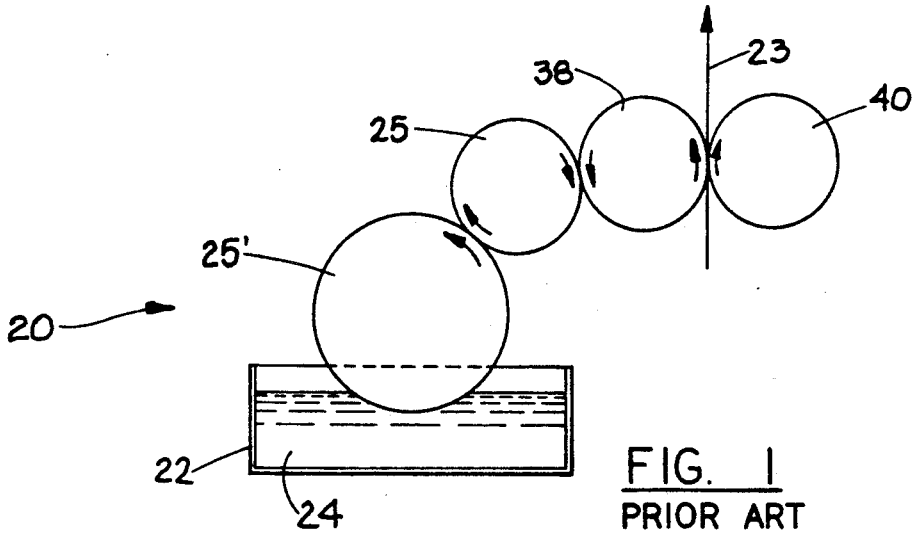
FIG. 1 PRIOR ART
FIG. 1 is a schematic side elevational view of an open reservoir type printing apparatus according to the prior art.

As illustrated in FIG. 1, an open reservoir type printing apparatus 20 according to the prior art has a fountain roll 25', which cyclically dips into a reservoir 22 of ink 24 and supplies ink 24 through a metering nip to an anilox roll 25. Ink 24 is transferred from the anilox roll 25 to a plate cylinder 38 having a desired and predetermined pattern on its periphery. The pattern on the plate cylinder 38 may be formed by a design on a plate which is removably attached to the core of the plate cylinder 38.

The plate cylinder 38 is juxtaposed with an impression cylinder 40 to define a nip therebetween. The substrate 23 passes through this nip and the desired pattern of ink 24 is applied from the plate cylinder 38 to the substrate 23.

The amount of ink 24 transferred from the anilox roll 25 to the plate cylinder 38, and subsequently to the substrate 23, is controlled by the metering nip formed between the fountain roll 25' and anilox roll 25. Excess ink 24 is not squeegeed through this nip, but instead falls back into the reservoir 22 under the influence of gravity.

Several problems exist with this system. For example, very imprecise metering of the ink 24 through the nip formed between the fountain and anilox rolls 25 and 25' occurs. An undesired phenomenon inherent and congenital to this apparatus 20 is splashing of the ink 24 as it falls back into the reservoir 22. Splashing of the ink 24 causes problems, such as expensive wastage of ink 24, and creates hygiene problems when the ink 24 lands on the floor—causing it to be slippery. Other hygiene problems occur when the ink 24 splashes onto the skin and clothing of nearby workers.

Figure 2:
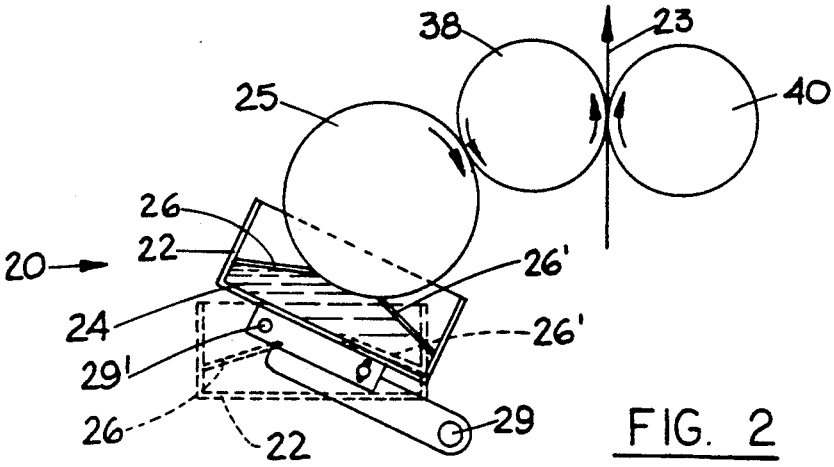
FIG. 2 PRIOR ART
FIG. 2 is a schematic side elevational view of a chamber fountain type closed reservoir printing apparatus according to the prior art, showing, in phantom, the reservoir and the anilox roll in the separated position.

Referring to FIG. 2, one attempt to solve these problems is through the chamber fountain type printing apparatus 20. In the chamber fountain type printing apparatus 20, the boundary of the reservoir 22 is defined, in part, by two doctor blades 26 and 26' which are held in contacting relationship with the anilox roll 25. This boundary helps to prevent ink 24 from leaving the reservoir 22 in an uncontrolled manner.

This arrangement simplifies the open reservoir 22 type apparatus 20 of FIG. 1 by eliminating the fountain roll 25', but creates other problems. For example, the reservoir 22 of the chamber fountain type printing apparatus 20 must be pressurized, otherwise the boundary layer of air associated with the periphery of the anilox roll 25 as it rotates prevents complete coverage of ink 24 on the anilox roll 25. Fading or streaking of the pattern to be printed onto the substrate 23 may then likely occur. Thus, the pressure in the reservoir 22 should not be too light, otherwise an incomplete pattern may be applied to the substrate 23.

If the pressure in the reservoir 22 is too great, ink 24 may be blown past either or both of the two doctor blade 26 and 26' and undesired splashing of the ink 24 will again occur, resulting in the aforementioned waste of ink 24 and hygiene problems. If the pressure in the reservoir 22 is much too great, the doctor blade 26 and 26' or end seals of the reservoir 22 may not hold the resulting force and either component may be blown from the reservoir 22—breaching the pressure boundary. Undesired splashing of ink 24 will again occur.

Furthermore, the in-running nip defined by the upstream doctor blade 26' of the apparatus 20 may receive a significant quantity of debris. For example, in addition the dust and dirt found in many manufacturing environments, lint, or other matter may be transferred from the substrate 23 through the plate cylinder 38 to the anilox roll 25. This debris may build up and be interposed in the in-running nip between the doctor blade 26' and the anilox roll 25. The interposed debris may cause the doctor blade 26' to deform and, again, ink 24 to splash out from the pressurized reservoir 22. Alternatively, the debris may pass through the in-running nip and enter the reservoir 22, potentially contaminating its contents.

A problem found in either the open reservoir 22 type printing apparatus 20 of FIG. 1 or the chamber fountain type printing apparatus 20 of FIG. 2 is the separation of the reservoir 22 from the balance of the apparatus 20. According to an apparatus 20 of the prior art, the reservoir 22 is hingeably connected to the frame of the apparatus 20.

As illustrated in FIG. 2, the hingeable connection of the reservoir 22 requires a complex apparatus 20 having two pivot points 29 and 29'. One pivot point 29 is at the base of a pivot arm supporting the reservoir 22 and allows the pivot arm to articulate for gross positioning of the reservoir 22. The second pivot point 29' is on the pivot arm remote from the first pivot point 29. A pivot arm articulated from the second pivot point seats the reservoir 22 against the anilox roll 25 to seal the pressure boundary formed by the doctor blades 26 and 26' as tightly as practical.

When it is necessary to do maintenance on the apparatus 20, the ink 24 is drained from the reservoir 22. The reservoir 22 is then pivoted away from the anilox roll 25 utilizing the two pivot arms.

Several problems are inherent and congenital to this arrangement. First, draining the reservoir 22 adds to the downtime of the apparatus 20 and increases production costs. Also, when the reservoir 22 is inclined from the position to which it is pivoted for maintenance, residual ink 24 often drains over the lowest edge of the reservoir 22, onto lower placed equipment and again causes the aforementioned hygiene problems and resultant waste.

Figure 3:
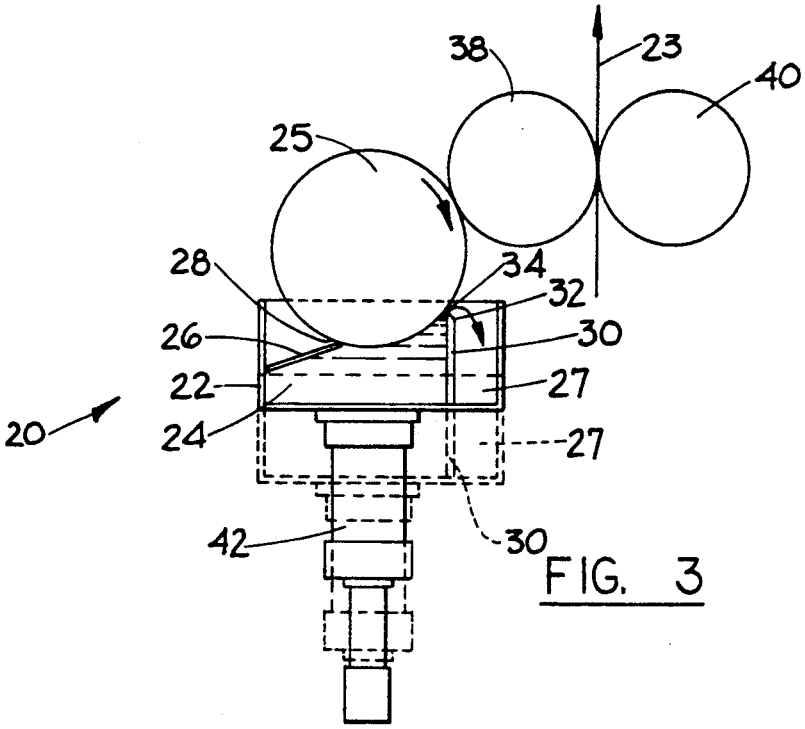
FIG. 3 is a schematic side elevational view of a printing apparatus according to the present invention.

Referring to FIG. 3, one embodiment of an apparatus 20 according to the present invention comprises a reservoir 22 for holding the ink 24 to be printed onto the substrate 23, a means for supplying ink 24 to the reservoir 22 and an axially rotatable anilox roll 25 at least partially submerged in the ink 24 held in the reservoir 22. The anilox roll 25 is parallel to and in contacting relationship with a plate cylinder 38 forming a nip therebetween. The plate cylinder 38 is parallel to and juxtaposed with an impression cylinder 40 forming a nip between which the substrate 23 onto which the ink 24 passes through to be applied onto the substrate 23. Collectively, the anilox roll 25, plate cylinder 38, and the impression cylinder 40 serve as a removal and application means for removing ink 24 from the reservoir 22 and applying it to the substrate 23. Components of the apparatus 20 not illustrated may include a transport means for transporting the substrate 23 relative to the other components of the apparatus 20 and a means for rotating the anilox roll 25 and the plate and impression cylinders 38 and 40.

The apparatus 20 may further comprise a doctor blade 26 parallel to and in contacting relation with the anilox roll 25 and a weir 30 parallel and radially spaced from the anilox roll 25. The doctor blade 26 and weir 30 form part of the boundary of the reservoir 22 holding the ink 24.

Conceptually, while in operation, the apparatus 20 may be thought of as having one (or more) ink supply, or inlet, to the reservoir 22. Ink 24 in the reservoir 22 is divided into two ink removal paths. One ink removal path, of course, is to the substrate 23, to be applied thereon in a predetermined pattern. The second ink removal path is a controlled bleedoff of ink 24 which is not transferred onto the substrate 23. The second ink removal path may be further subdivided into a plurality of secondary ink removal paths.

Figure 4:
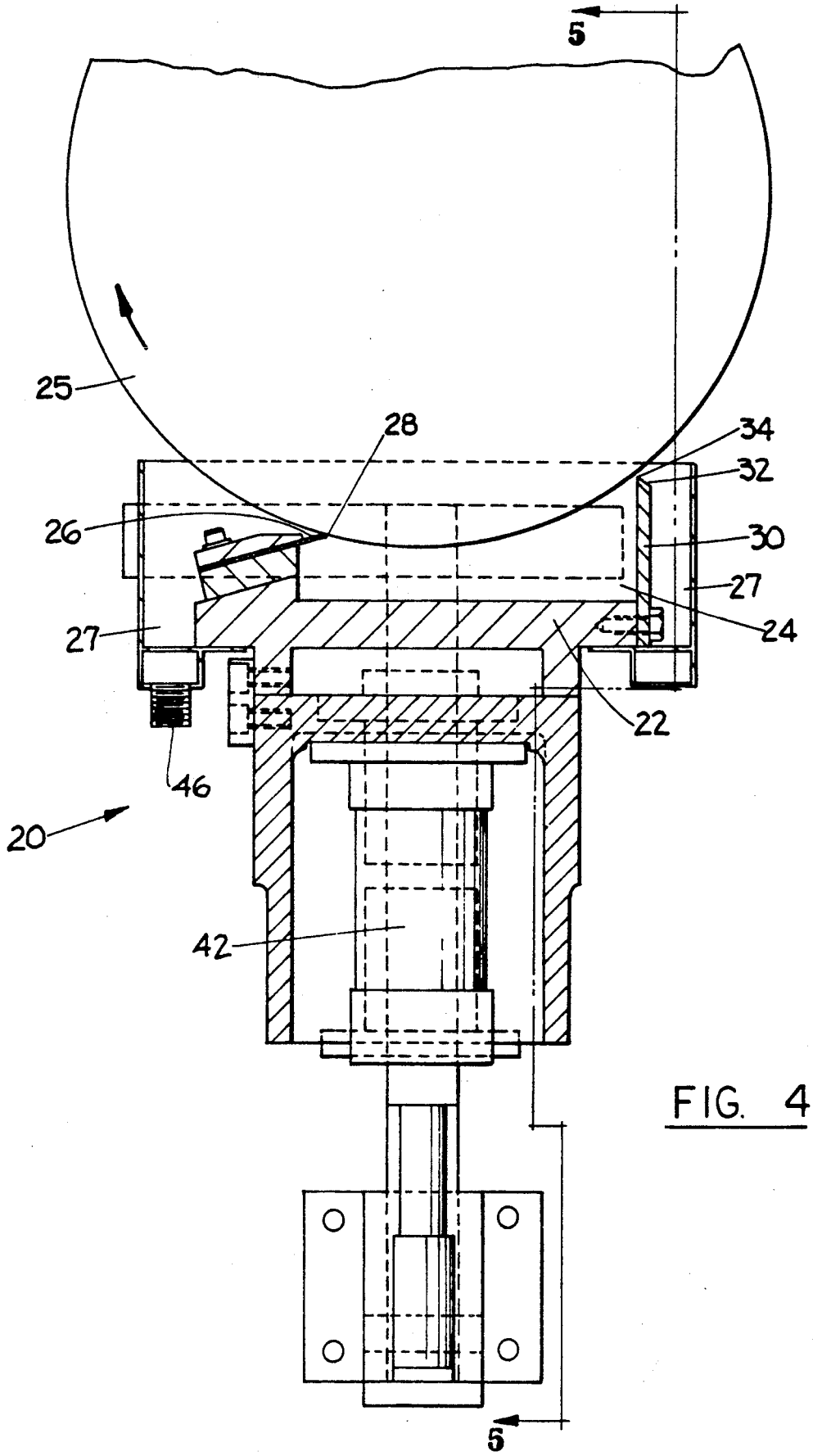
FIG. 4 is an enlarged fragmentary side elevational view of the apparatus of FIG. 3, having an orifice formed between the anilox roll and the distal edge of the weir.

Referring to FIG. 4 and examining each component of the apparatus 20 in more detail, the reservoir 22 is a leak-proof chamber to hold and contain the ink 24 utilized in the printing, or other applying, process. The volume of the reservoir 22 should be relatively small, about 7.6 to about 23 liters (2 to 6 gallons) to minimize ink 24 residence time in the high shear force environment of the reservoir 22, and the loss of ink 24 in the event of contamination of or leakage from the reservoir 22. The reservoir 22 is very long, in the direction of the axis of the anilox roll 25, compared to its cross-sectional area.

The reservoir 22 should be constructed of a material which will not corrode or leech contaminants into the ink 24. The reservoir 22 may be advantageously made of stainless steel or a fiberglass epoxy, as are well known in the art.

The ends of the reservoir 22 are defined by conventional contact seals, as are well known in the art. Suitable seals may be made according to the teachings of U.S. Pat. No. 4,581,995 issued Apr. 15, 1986 to Stone, which patent is incorporated herein by reference for the purpose of illustrating suitable end seals.

One boundary of the reservoir 22 is defined by a doctor blade 26. The doctor blade 26 is rigidly clamped at a proximal edge and has a distal edge 28 extending outwardly to contact the anilox roll 25 within a window of about 15 degrees after bottom dead center to about 35 degrees before bottom dead center, so that ink 24 is prevented from leaking out of the reservoir 22 when it is subjected to pressure and proper wiping of the ink 24 from the periphery of the rotating anilox occurs.

The doctor blade 26 should be held in angular relation relative to the tangent to the anilox roll 25 at the distal edge 28 of the doctor blade 26. An included angle of about 30° to about 35° has been found to work well. As the position of contact between the distal edge 28 of the doctor blade 26 and the periphery of the anilox roll 25 is adjusted about the periphery of the anilox roll 25 within the aforementioned window, the angle of the doctor blade 26 should be adjusted to maintain a constant angular relation relative to the tangent at the periphery of the anilox roll 25. For example, if the distal edge 28 of the doctor blade 26 contacts the anilox roll 25 about 14° after bottom dead center, the doctor blade 26 should be held in an angular relation to the bottom of the reservoir 22 of about 18° to maintain the proper angular relation to the tangent line.

Another boundary of the reservoir 22 is defined by a weir 30. The weir 30 is clamped at a proximal edge and extends to a distal edge 32 juxtaposed with the periphery of the anilox roll 25. For an anilox roll having an axial length of about 264 centimeters (104 inches) the distal edge 32 of the weir 30 is radially spaced outwardly from the periphery of the anilox roll 25 a distance of about 1.5 to about 2.3 millimeters (0.060 to 0.090 inches) and defines the top of the weir 30. The distal edge 32 of the weir 30 may be bevelled, as shown, to provide less horizontal surface area for the accumulation of debris.

Figure 5:
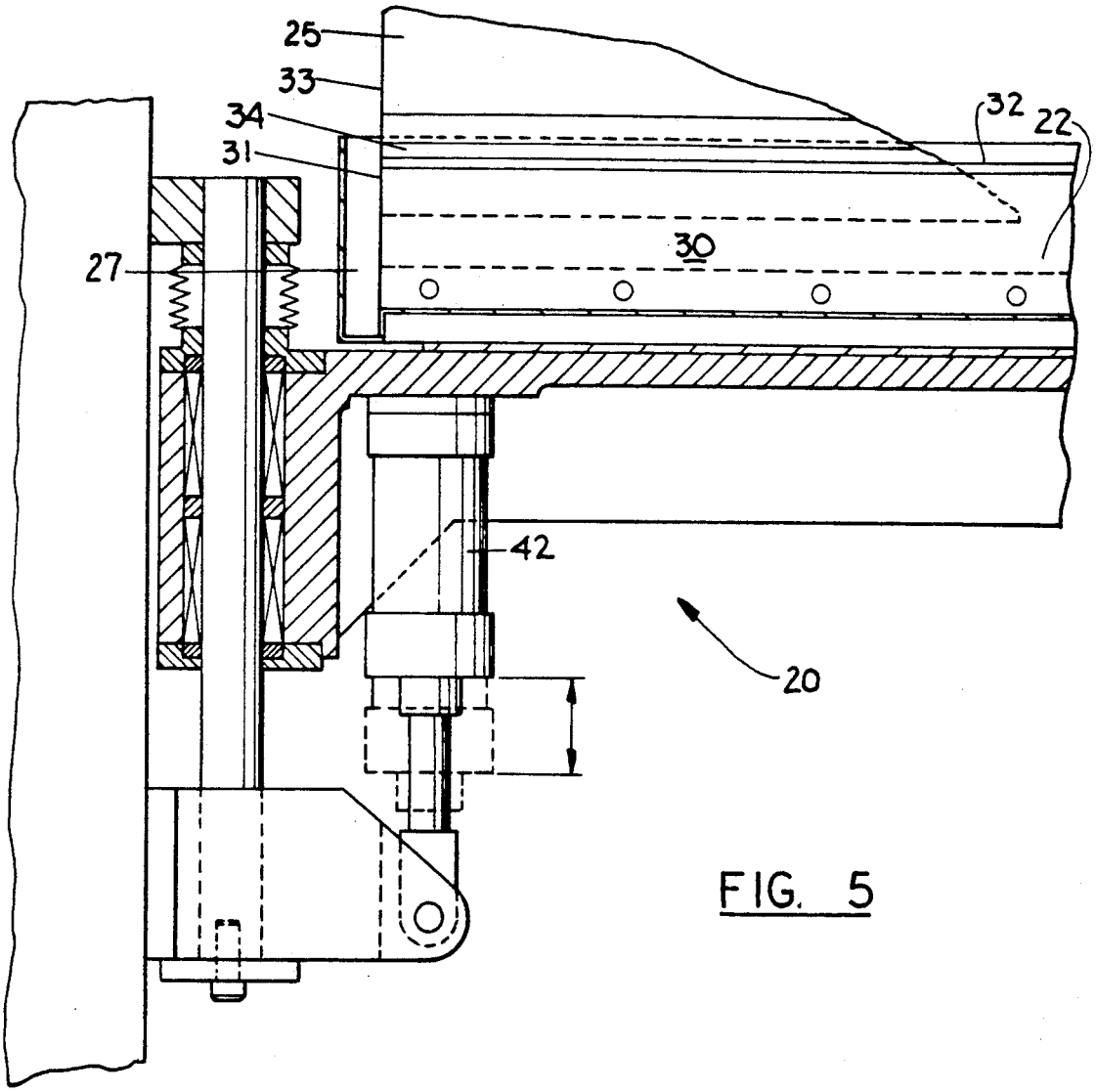
FIG. 5 is a fragmentary partial cross-sectional frontal elevational view taken along line 5—5 of FIG. 4 and looking in the direction of the weir, with the reservoir and anilox roll shown in the operating position.

As illustrated in FIG. 5, the length of the weir 30 is defined by two oppositely disposed ends 31. The ends 31 of the weir 30 may be coincident, inboard of or outboard of the ends 33 of the anilox roll 25. However, it is not required each end 31 of the weir 30 be disposed in the same position relative to the respective end 33 of the anilox roll 25. For example, one end 31 of the weir 30 may be inboard the respective end 33 of the anilox roll 25 and the other end 31 of the weir 30 outboard the respective end 33 of the anilox roll 25. The selection of placement of the ends 31 of the weir 30 will be dependent upon the type of orifice 34 used to remove ink 24 from the reservoir 22 without transferring such ink 24 to the substrate 23 and dictated by the type of end seals utilized.

Referring again to FIG. 4, it is important that the distal edge 32 of the weir 30 be higher in elevation than the distal edge 28 of the doctor blade 26, so that the ink 24 maintains a constant static head against the doctor blade 26 and the anilox roll 25. The static head is necessary to ensure that the boundary air layer associated with the rotating periphery of the anilox roll 25 is not present, so that anilox roll 25 starvation of ink 24 does not occur and fading or streaking of the pattern to be applied onto the substrate 23 is obviated.

For the apparatus 20 described herein, a differential elevation between the distal edge 28 of the doctor blade 26 and the distal edge 32 of the weir 30 of about 2.5 to about 15 centimeters (1 to 6 inches) has been found suitable. It is to be recognized that as the peripheral velocity of the anilox roll 25 increases, the elevation difference should likewise increase to maintain the proper head of ink 24 against the doctor blade 26, so that the air boundary layer is destroyed. If the boundary layer is not destroyed, it may result in anilox roll 25 starvation and hence aforementioned fading or streaking of the pattern to be printed.

The radial gap between the distal edge 32 of the weir 30 and the periphery of the anilox roll 25 results in a orifice 34 through which ink 24 may flow from the reservoir 22 into a spillway 27. The supplied ink 24 flows over the top of the weir 30 and out of the reservoir 22. This process provides for controlled bleedoff and removal of the ink 24 from the reservoir 22 without transfer of such ink 24 to the substrate 23.

One border of this orifice 34 is defined by the distal edge 32 of the weir 30 and another border of the orifice 34 is defined by the removal and application means. The length of the orifice 34, taken in the axial direction, is determined by the axial length of the removal and application means, such as the anilox roll 25. The weir 30 is not necessarily, but preferably, substantially parallel the anilox roll 25. As the axial length of the orifice 34, and hence the cross-sectional area of the orifice 34, increase, the operation of the apparatus 20 becomes less sensitive to the radial spacing of the weir 30 from the periphery of the anilox roll 25.

This arrangement produces an orifice 34 having the shape of a horizontally oriented high aspect ratio rectangle. While other orifice 34 shapes are suitable, this arrangement provides the advantage that the doctor blade 26 at the in-running nip is eliminated, and the apparatus 20 is much less susceptible to loss of ink 24 due to violation of the reservoir 22 pressure boundary by lint, dust, and other debris, since no pressure boundary is maintained at this orifice 34.

The weir 30 and associated orifice 34 provide a means for controlling the ink supply means relative to the reservoir 22, so that ink 24 is substantially continuously removed from the reservoir 22 in a controlled manner and without transfer to the substrate 23. As used in conjunction with the ink supplying means, the weir 30 and associated orifice 34 also provide a means for creating a backpressure in the reservoir 22. As used herein, ink 24 is considered to be removed from the reservoir 22 in a "controlled manner" if such removal occurs at a known rate, within a provided range, and without significant surges or lags occurring in a random fashion. It will be apparent that the rate of ink removal through this orifice is less than the rate of supply of ink to the reservoir due to the ink 22 removed for transfer to the substrate 23.

Ink 24 removed through this orifice 34 may enter a spillway 27. The spillway 27 may be open to the atmosphere and, if desired, may provide for recirculation of the ink 24 which flows across the top of the orifice 34 and through the weir 30 to the ink supply and subsequent recycling of such ink 24. It is to be recognized that ink 24 which is removed from the reservoir 22 through the orifice 34 and spillway 27 is not printed onto, or otherwise transferred to, the substrate 23 (at the time of removal), but instead is discarded and either not used or, preferably, is recycled (to be later applied onto the substrate 23) depending upon whether or not the ink 24 removed through the spillway 27 is discarded or recycled. Such ink 24 is referred to as "nontransferred ink."

The weir 30 and the doctor blade 26 are disposed in a relationship so that the doctor blade 26 is downstream of the weir 30. As used herein "downstream" refers to the direction of rotation of the anilox roll 25, and more particularly, to the portion of the arc subtended by the reservoir 22 when measured in the direction of rotation of the anilox roll 25. Alternatively, the weir 30 may be thought of as being "upstream" of the doctor blade 26.

The ink 24 is any liquid composition which may be applied onto a substrate 23 in a predetermined pattern. As used herein "a predetermined pattern" refers to any nonrandom desired array of application of ink 24 onto the substrate 23 and is inclusive of all combinations of patterns ranging from small individual dots to complete coating of the entire surface of the substrate 23. As used herein "ink" refers to any liquid composition applied to the substrate 23 and which remains thereon (even though components of the ink may evaporate). The ink 24 may, but need not, be visible to the naked eye.

Preferably, the ink 24 is a flexographic type ink and has a defoaming agent to prevent entrained air from the boundary layer associated with the anilox roll 25 from causing the ink 24 to not completely coat the anilox roll 25 and to obviate streaking or fading of the desired pattern. Preferably, the ink 24 has a dynamic viscosity of about five to about 10 centipoises as measured in about 14 to about 22 seconds in a Number 2 Shell cup. The ink 24 may be water based and have a pigment size of about 5 to about 25 microns.

Other rheological properties of the ink 24, such as rewetability, tackiness, and surface tension should be considered. These properties should be predetermined and established to ensure the ink 24 is compatible with and matched to the anilox roll 25. For example, if the surface tension of the ink 24 is too great, the ink 24 may not be easily removed from the anilox roll 25 and properly applied to the substrate 23. Conversely, if the surface tension of the ink 24 is too low, the ink 24 may not be adequately picked up by the anilox roll 25 from the reservoir 22. A preferred ink 24 is sold by the General Printing Ink division of the Sun Chemical Company of Fort Lee, N.J., as water based towel ink The apparatus 20 further comprises an ink supplying means (not shown) for supplying ink 24 to the reservoir 22. The ink supplying means for supplying ink 24 to the reservoir 22 should be capable of supplying ink 24 at a changeover rate of about every 0.5 to about every six minutes. For the apparatus 20 described herein, a preferred ink supplying means is a positive displacement peristaltic pump, having a pulsation dampener, which continuously supplies ink 24 to the reservoir 22 at the rate of about 3.8 to about 38 liters per minute (one to 10 gallons per minute), and preferably at a rate of about 5.7 to about 7.6 liters per minute (1.5 to 2 gallons per minute).

The ink supplying means for supplying ink 24 to the reservoir 22 and the orifice 34 defined between the distal edge 32 of the weir 30 and the anilox roll 25 may operate in conjunction to create a backpressure in the reservoir 22. Thus, the backpressure may be caused by the difference between the rates of ink 24 supply and ink 24 removal or, alternatively, by the static head created by the weir 30.

The influx of ink 24 from the ink supplying means for supplying ink 24 to the reservoir 22 is generally equivalent the aggregate of ink 24 which passes the doctor blade 26 with rotation of the anilox roll 25 and the ink 24 removed through the orifice 34 to the spillway 27—so that slight pressurization of the ink 24 in the reservoir 22 results, but not generally time dependent accumulation during steady, state operation. A backpressure in the reservoir 22 is necessary for the apparatus 20 to work well, with a generally higher backpressure being required as the peripheral velocity of the anilox roll 25 increases.

Preferably, the ink supplying means for supplying ink 24 to the reservoir 22 continuously replenishes the reservoir 22 with ink 24, to maintain the aforementioned desired static head as constant as possible. Therefore, it is generally not preferred that the ink 24 be added to the reservoir 22 in a batch process, otherwise it is difficult to maintain the desired static head in the reservoir 22. It will be well understood by one skilled in the art that the ink supplying means for supplying ink 24 to the reservoir 22 may advantageously include a filtration system or a particle separator to remove lint, dust, and other contaminants from the ink 24—particularly if the ink 24 is recirculated from the spillway 27 and is to be recycled back into the reservoir 22.

The ink 24 removed from the reservoir 22 through the orifice 34 may be collected in the spillway 27, as noted above, to assure the ink does not splash, create hygiene problems, or is otherwise wasted. The spillway 27 is outboard of and below the weir 30, so that ink 24 passing through the orifice is readily captured therein.

The spillway 27 may advantageously circumscribe the anilox roll 25 and the reservoir 22. Preferably, the spillway 27 is crowned at the midpoint and beveled downwardly from a peak substantially coincident the axial midpoint of the weir 30 to two low points outboard either end of the weir 30. A slight draft about 0.3° to about 1°, is adequate.

At each low point in the spillway 27 is a gravity drain collection 46. The gravity drain collection 46 either collects the ink 24 for batch or continuous discard, or preferably continuously recirculates the ink 24 to the ink supplying means for supplying ink 24 to the reservoir 22 so that the ink 24 may be recycled to the reservoir 22—and later transferred to the substrate 23 in a closed loop. It will be apparent to one skilled in the art that a convenient way to recycle collected ink 24 is to recirculate such ink 24 to the aforementioned position displacement pump suction for supply to the reservoir 22.

Preferably, the ink 24 is introduced to the reservoir 22 from a supply line (not shown) at an elevation coincident the bottom of the reservoir 22, and a lateral position not upstream of bottom dead center, otherwise an undesired vortex may occur under the doctor blade 26, causing anilox roll 25 starvation. The ink supplying means for supplying ink 24 to the reservoir 22 should have a volume of ink 24 about one to about six times greater, preferably about four to about six times greater than the volume of ink 24 in the reservoir 22 itself.

If the volume of ink 24 in the reservoir 22 is too great compared to the volume of the ink supplying means for supplying ink 24 to the reservoir 22, the ink 24 may have too long of a residence time in the reservoir 22, resulting in shearing and foaming of the ink 24. This is highly undesirable as incomplete coverage of the anilox roll 25 may result, and cause fading or streaking of the pattern to be applied to the substrate 23.

Conversely, if the volume of the reservoir 22 is too small compared to the volume of the ink supplying means for supplying ink 24 to the reservoir 22, the rotating anilox roll 25 will not be submerged in the ink 24 for a period of time long enough to be completely coated, entrained air may displace a significant or excessive quantity of ink 24, and incomplete coverage again results. Furthermore, the reservoir 22 should not be too shallow, i.e., less than about 1 centimeter (0.375 inches), otherwise the reservoir 22 becomes more sensitive to standing waves of ink 24, and anilox roll 25 starvation may again occur.

The anilox roll 25 is the component of the apparatus 20 which removes ink 24 from the reservoir 22 and applies the ink 24 onto the substrate 23 in a metered fashion. As used herein, the steps of removal of ink 24 from the reservoir 22 and the application of ink 24 onto the substrate 23 are collectively referred to as "transfer" of the ink 24. The anilox roll 25 may be used in conjunction with other components, so that the transfer of the ink 24 to the substrate 23 does not occur directly. Instead the ink 24 may be removed from the reservoir 22 and indirectly transferred to the substrate 23 through another component, such as a plate cylinder 38.

The anilox roll 25 is generally cylindrical and has small cells disposed throughout its periphery to attract and pick up ink 24 from the reservoir 22 through capillary action and to later transfer such ink 24 to the substrate 23 through adhesion and/or capillary action. The anilox roll 25 may have a laser engraved, ceramic coated surface finish of at least about 40 cells per centimeter (100 cells per inch) having a minimum depth of about 10 microns. The anilox roll 25 has an "axis" extending through the center of any cross-section, and is rotatable about this axis. The cells may be oriented at about 45° off the axis of the anilox roll.

The anilox roll 25 is preferably mounted so that minimal vibration, and hence splashing of ink 24, occurs. The diameter of the anilox roll should not be too small compared to its length, otherwise excessive runout and vibration may occur. The anilox roll 25 should have a diameter of at least about 20 percent of the axial length of the anilox roll 25, with a higher percentage diameter being preferred for higher rotational velocities.

The anilox roll 25 is partially submerged in the reservoir 22 of ink 24. As used herein, "partially submerged" refers to the condition where at any instant in time, a portion of the anilox roll 25 periphery is wetted by the ink 24 and a portion of the anilox roll 25 is exposed to the atmosphere. The wetted portion of the periphery is intermediate the weir 30 and the doctor blade 26, as measured in the direction of rotation of the anilox roll 25. The portion of the anilox roll 25 exposed to the atmosphere is intermediate the doctor blade 26 and the weir 30, as measured in the direction of rotation of the anilox roll 25.

The arc subtended by the wetted portion of the periphery of the anilox roll 25 is dependent upon the diameter of the anilox roll 25, the surface finish of the anilox roll 25, and the peripheral speed of the anilox roll 25. Generally, as the peripheral speed of the anilox roll 25 (which is, of course, dependent upon the diameter) or the cell volume increases, a greater residence time in the reservoir 22 is necessary to insure complete coating of the ink 24 on the periphery of the anilox roll 25.

For the apparatus 20 described herein, each axially oriented line on the periphery of the anilox roll 25 should have a residence time in the ink 24 of about 0.004 to about 0.035 seconds. For an anilox roll 25 having a diameter of about 38.3 centimeters (15.078 inches), a wetted length of about 10.2 to about 17.8 centimeters (4 to 7 inches) has been found suitable for peripheral velocities of about 305 to about 915 meters per minute (1,000 to 3,000 feet per minute) with greater wetted lengths being necessary as higher peripheral anilox roll 25 velocities are encountered.

If desired for the particular ink 24 removal and application process, parallel to and juxtaposed with the anilox roll 25 is a plate cylinder 38. The plate cylinder 38 is preferably in contacting relation with the anilox roll 25 to define a nip through which the ink 24 to be applied onto the substrate 23 passes. The plate cylinder 38 and anilox roll 25 should be geared to rotate at the same peripheral velocity.

If desired for the particular ink 24 removal and application process, parallel to and juxtaposed with the plate cylinder 38 is an impression cylinder 40, which defines a nip, through which the substrate 23 passes. The impression cylinder 40 provides a rotating anvil, so that a resisting force is maintained against the substrate 23 as the plate cylinder 38 presses the desired pattern against the substrate 23. By passing through the nip formed between the plate cylinder 38 and the impression cylinder 40, the substrate 23 may be compressed, generally normal to its plane, so that proper and high speed transfer of the ink 24 to the substrate 23 can occur and the desired pattern is fully applied to and maintained on the substrate 23.

The anilox roll 25 and plate cylinder 38 counter-rotate relative to one another, so that at the nip formed therebetween, the tangential velocities occur in the same sense. Likewise, the plate cylinder 38 and impression cylinder 40 counter-rotate relative to one another, so that the tangential velocities at the nip through which the substrate 23 passes occurs in the same sense. Of course, then, it will be apparent to one skilled in the art that the anilox roll 25 and impression cylinder 40 rotate in the same direction.

As used herein, the "substrate 23" refers to any substantially planar, two-dimensional web, sheet, lamina, laminae or laminate having two opposed faces, onto one of which the ink 24 is applied. The substrate 23 is preferably hydrophilic and may be absorbent. A particularly preferred substrate 23 is a cellulosic fibrous structure, such as a toilet tissue, a facial tissue, or a paper towel, having a basis weight of about 3.7 to about 13.4 kilograms per square meter (15 to 55 pounds per 2880 square feet) and is made of a blend of hardwood and softwood kraft fibers.

The substrate 23 may receive the ink 24 in a substantially continuous pattern, in a substantially intermittent pattern, in a discontinuous pattern, or may be entirely coated with the ink 24. It is to be recognized that while the apparatus 20 described herein is intended to print ink 24 on only one face of the substrate 23, a second and complementary apparatus 20 may be used to print the same or a different pattern on the opposed face of the substrate 23.

The apparatus 20 is also provided with a transport means (not shown) for transporting the substrate 23 relative to the anilox roll 25 or relative to any other means used for removal and application of the ink 24. Suitable, common and well known transport means include a feed roll and a draw roll system, or an unwind stand and a rewind stand system. Preferably, the substrate 23 passes through the nip defined by the plate cylinder 38 and impression cylinder 40 at a velocity equal to the peripheral velocity of the plate cylinder 38 and impression cylinder 40, so that no wiping against the plate cylinder 38 occurs and constant tension is maintained on the substrate 23, obviating wrinkling or tearing.

Referring again to FIG. 5, the apparatus 20 may further comprise a means for relative separation of the reservoir 22 and the balance of the apparatus 20, particularly the anilox roll 25, from one another by linear translation of either such component. A preferred means for separating the reservoir 22 and anilox roll 25 from one another is a linear translating device mounted below, and connected to, the reservoir 22. The linear translating device may include any well known hardware, such as jack screws, pneumatic cylinders, or preferably hydraulic cylinders 42.

Two mutually parallel, vertically mounted hydraulic cylinders 42 may be utilized, one at either end of the reservoir 22. The hydraulic cylinders 42 should be securely and rigidly mounted to the bottom or side of the reservoir 22, so that as the reservoir 22 is lowered away from the anilox roll 25, no rotation or pivoting of the reservoir 22 occurs relative to the hydraulic cylinders 42. The hydraulic cylinders 42 should be able to support the weight of the reservoir 22, when fully loaded with ink 24, and actuated in unison to prevent either end of the reservoir 22 from obtaining more than a minimal difference in elevation relative to the other end of the reservoir 22.

The hydraulic cylinders 42 should have a stroke sufficient to clear the top of the reservoir 22 from the bottom of the anilox roll. A stoke of at least about 6.4 centimeters (2.5 inches) is typically necessary. Hydraulic cylinders 42 having a bore of about 6.4 centimeters (2.5 inches) and rated for about $880 \times 10^3$ kilograms per square meter (1,250 pounds per square inch) pressure have been found to work well. For the embodiment described herein, Series 7L hydraulic cylinders manufactured by the Ortman-Miller Company of Hammond, Ind. have been found suitable. Each hydraulic cylinder 42 may be mounted on precision synthetic bushings 43, such as are sold by Beemer Precision, Inc. of Fort Washington, Pa., under part number L-2438-24. The bushings 43 are in turn rigidly mounted to the frame of the apparatus, so that the bushings 43 are parallel the hydraulic cylinders 42.

Figure 6:
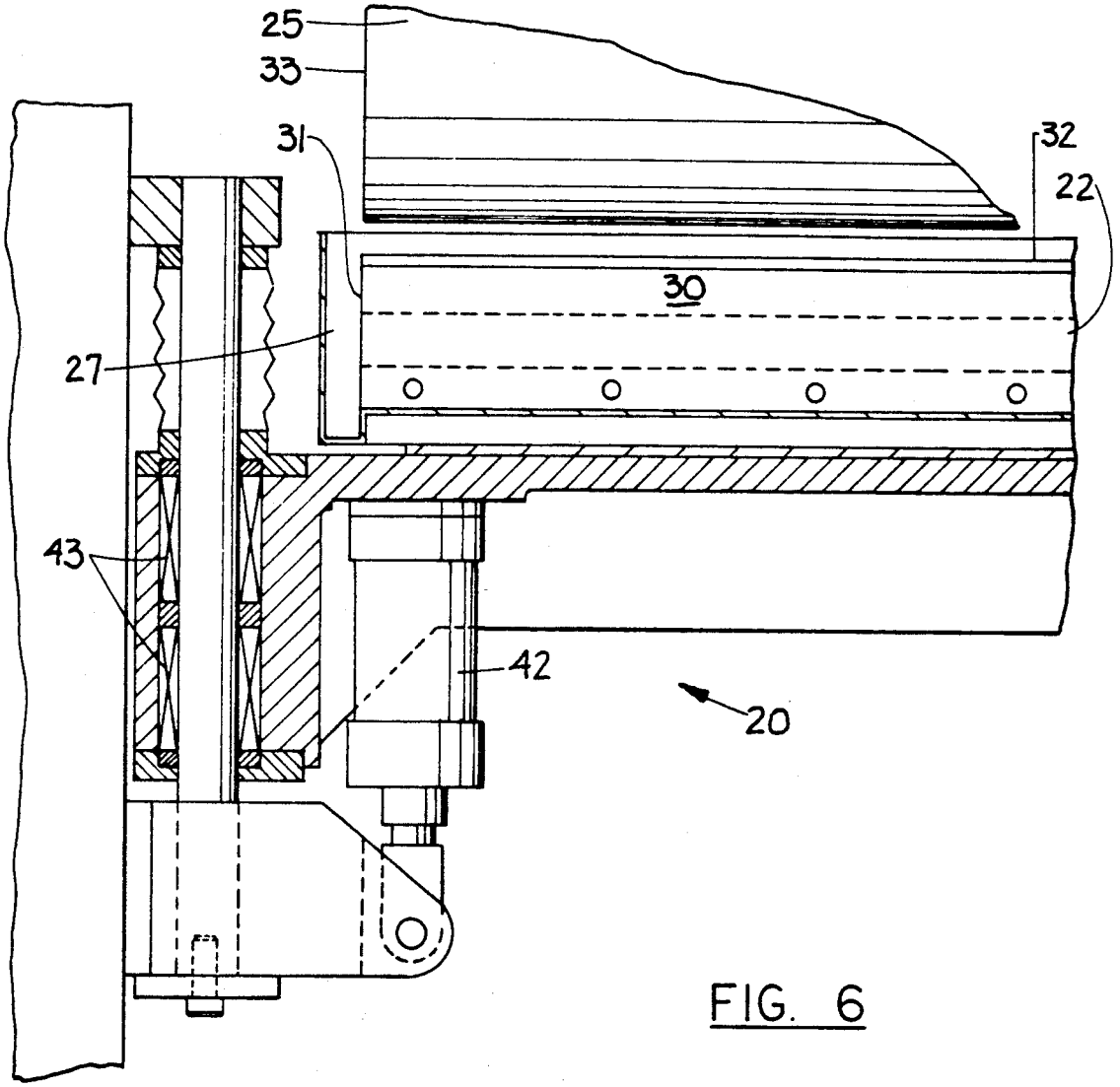
FIG. 6 is a fragmentary front elevational schematic view of the apparatus of FIG. 5 with the reservoir and the anilox roll shown in the separated position.

Referring to FIG. 6, this arrangement obviates a hingeable connection and pivotal separation of the anilox roll 25 and reservoir 22 from one another. This allows the depth of ink 24 dictated by the elevation of the doctor blade 26 from the bottom of the reservoir 22 to be maintained when the reservoir 22 is in the lowered position. Utilizing this arrangement, routine maintenance may be performed on the apparatus 20, without draining of the reservoir 22. For example, the doctor blade 26 may be changed, the anilox roll 25 may be inspected, lubrication of rotatably mounted components may occur, or the reservoir 22 and the spillway 27 may be cleaned.

Spillage, and hence hygiene problems and waste of expensive ink 24, which occur when a pivotally mounted reservoir 22 is separated from the anilox roll 25 are obviated. Utilizing this arrangement provides the further advantage that once the equipment is shut down, maintenance may occur with less downtime, due to eliminating the step of draining the reservoir 22.

Figure 7:
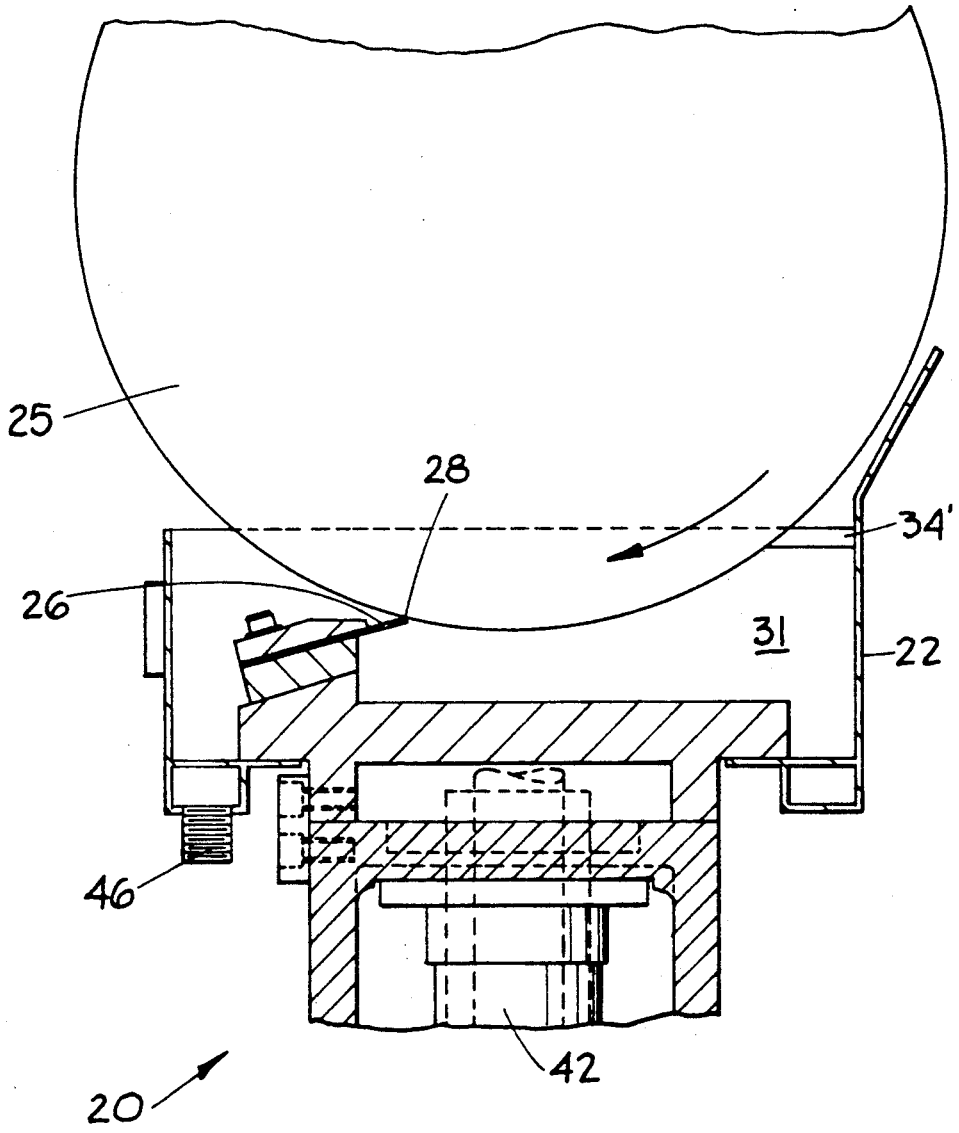
FIG. 7 is an enlarged fragmentary side elevational view of an alternative embodiment of the invention of FIG. 4, having an orifice formed between the anilox roll and the end of the weir, and deleting details of the linear translating means for clarity.

Referring to FIG. 7, in an alternative embodiment, the weir 30 may be in contacting relation with the anilox roll 25 and one or two orifices 34' defined by either or both ends 31 of the weir 30. In such an embodiment, the ends 31 of the weir 30 are provided with the aforementioned contact seals as described above. However, the seals are notched at the top to be open to the spillway 27. This provides an orifice 34' at each end 31 of the weir 30. While it is feasible to have one end 31 of the weir 30 open to form an orifice 34' and one end 31 of the weir 30 sealed, it is preferred both ends 31 are open so that a balanced flow is obtained without exerting thrust on the sealed end 31.

Such an orifice 34' has a boundary defined by the removal and application means, particularly the anilox roll 25 and a boundary 34' defined by the weir 30. The nontransferred ink is removed through these orifices 34' by flowing axially relative to the anilox roll 25, as opposed to the aforementioned embodiment of FIG. 4, which causes nontransferred ink 24 to flow tangential to the anilox roll 25.

It will be further apparent to one skilled in the art that several variations of the described and claimed apparatus 20 are feasible. For example, the weir 30 may be radially spaced from the anilox roll 25 and one end 31 of the weir 30 open to the spillway 27. This provides an ink removal path having two orifices 34 and 34', one orifice 34' for axial flow of nontransferred ink and one orifice 34 for tangential flow of nontransferred ink. Of course, the weir 30 may be radially spaced from the anilox roll 25 and both ends 31 of the weir 30 unsealed and open to the spillway 27—so that the removal path for nontransferred ink may be conceptually subdivided into three paths: two having mutually opposed axial flow and one having the aforementioned tangential flow.

The anilox roll 25 may be removed and a gravure roll substituted in its place. The gravure roll, like the anilox roll 25 serves a means to remove ink 24 from the reservoir 22 and transfer it to the substrate 23 in a desired pattern. The only salient difference is that the desired pattern is, however, engraved into the periphery of the gravure roll, and outwardly raised from the periphery of the anilox roll 25.

Prophetically, it is not necessary that the weir 30 and associated orifice 34 be utilized for the purpose of providing a second ink 24 removal path for nontransferred ink 24. For example, the chamber fountain arrangement of FIG. 2 may be provided with an extraction tube, to which a vacuum or other low pressure device is applied, and which removes ink 24 from the reservoir 22 in a controlled manner relative to the influx of ink 24 from the ink supplying means for supplying ink 24 to the reservoir 22. Possibly, the velocity head pressure of ink 24 from the ink supplying means may be used in conjunction with the extraction tube to substantially continuously remove the desired quantity of ink 24 from the reservoir 22 in a controlled manner without transfer to the substrate 23.

Alternatively, the chamber fountain type apparatus 20 may be provided with a drain line 46 at the bottom of the reservoir 22, so that ink 24 may gravity drain therefrom and a separate vacuum or other low pressure extraction is obviated. Further, it will be apparent to one skilled in the art that the extraction tube and drain line 46 may be used together to remove ink 24 from the reservoir 22 at the desired rate. However, both such prophetic arrangements suffer from the drawback of the prior art that a reservoir 22 pressure boundary is maintained at the doctor blade 26' and is still subject to breech caused by accumulated debris.

What is claimed is:

1. An apparatus for applying ink to a substrate, said apparatus comprising:
   - a reservoir for containing ink;
   - an ink supplying means for supplying ink to said reservoir at a first rate;
   - an axially rotatable anilox roll partially submerged in said reservoir;
   - a transport means for transporting the substrate relative to said anilox roll so that said ink can be applied to said substrate in a preselected pattern;
   - an orifice for removing ink from said reservoir in a controlled manner without transfer to said substrate, said orifice having a border defined by a weir disposed substantially parallel to said anilox roll;
   - a doctor blade in juxtaposed relationship with said anilox roll; and
   - a means for vertically separating said reservoir, said weir, and said doctor blade from said anilox roll by vertical linear translation of at least one of said reservoir and said anilox roll.

2. An apparatus according to claim 1 wherein said separating means comprises a linear translating component selected from the group consisting of: a jack screw, a hydraulic cylinder and a pneumatic cylinder.

3. An apparatus according to claim 2 wherein said separating means comprises an hydraulic cylinder juxtaposed with each end of said apparatus.

4. An apparatus for applying ink to a substrate, said apparatus comprising:
   - a reservoir for containing ink:
   - an ink supplying means for supplying ink to said reservoir;
   - an axially rotatable roll partially submerged in said ink;
   - a transport means for transporting the substrate relative to said roll, so that said ink can be applied to the substrate in a preselected pattern;
   - an orifice for removing ink from said reservoir in a controlled manner without transfer to the substrate, said orifice having a border defined by a weir;
   - a doctor blade in juxtaposed relationship with said roll; and a means for vertically separating said reservoir, said weir, and said doctor blade from said roll by vertical linear translation of at least one of said reservoir and said roll, wherein said vertically separating means comprises at least one hydraulic cylinder juxtaposed with each end of said roll, each said one hydraulic cylinder being mounted on a vertically oriented bushing.

* * * * *

UNITED STATES PATENT AND TRADEMARK OFFICE

CERTIFICATE OF CORRECTION

PATENT NO. : 5,213,037

DATED : MAY 25, 1993

INVENTOR(S) : EMMETT LEOPARDI, II

It is certified that error appears in the above-identified patent and that said Letters Patent is hereby corrected as shown below:

Column 14, line 55 delete "ink:" and insert therefor --ink;--.

Signed and Sealed this

First Day of November, 1994

*Attest:*

*Attesting Officer*

Bruce Lehman

BRUCE LEHMAN

*Commissioner of Patents and Trademarks*